US006951156B2

(12) United States Patent
Garg

(10) Patent No.: US 6,951,156 B2
(45) Date of Patent: Oct. 4, 2005

(54) SOCKET

(75) Inventor: Ajay Garg, Plano, TX (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 10/739,328

(22) Filed: Dec. 19, 2003

(65) Prior Publication Data

US 2005/0132847 A1 Jun. 23, 2005

(51) Int. Cl.[7] ..... B25B 13/06
(52) U.S. Cl. ..... 81/121.1; 81/124.4
(58) Field of Search ..... 81/121.1, 124.3–124.6, 81/119, 176.2, 125; D8/29

(56) References Cited

U.S. PATENT DOCUMENTS

| | | | | |
|---|---|---|---|---|
| 838,109 | A | 12/1906 | Hanes et al. | |
| D59,417 | S | 10/1921 | Graham | |
| D108,143 | S | 1/1938 | Mandl | |
| 2,895,362 | A | 7/1959 | Jamgotchian | |
| D246,415 | S | 11/1977 | Critcher | |
| 4,328,720 | A * | 5/1982 | Shiel | 81/63 |
| 4,489,628 | A * | 12/1984 | Nicastro | 81/185 |
| 4,699,029 | A * | 10/1987 | Kelly et al. | 81/121.1 |
| 4,800,786 | A | 1/1989 | Arnold et al. | |
| 4,817,475 | A | 4/1989 | Kelly et al. | |
| 4,825,732 | A | 5/1989 | Arnold | |
| 4,882,958 | A * | 11/1989 | McNeeley | 81/124.4 |
| 4,947,713 | A | 8/1990 | Arnold | |
| 4,969,231 | A | 11/1990 | Mader et al. | |
| 4,970,917 | A | 11/1990 | McCollom | |
| 4,982,627 | A | 1/1991 | Johnson | |
| 5,009,133 | A | 4/1991 | Carey | |
| 5,031,488 | A | 7/1991 | Zumeta | |
| D319,562 | S | 9/1991 | Ballard | |
| 5,048,379 | A * | 9/1991 | Gramera et al. | 81/124.4 |
| 5,079,978 | A | 1/1992 | Kupfer | |
| D349,025 | S | 7/1994 | Romero | |
| 5,421,224 | A | 6/1995 | Bond | |
| D381,247 | S | 7/1997 | Zayat, Jr. | |
| 5,782,148 | A | 7/1998 | Kerkhoven | |
| D398,823 | S * | 9/1998 | Hsieh | D8/29 |
| 5,819,606 | A | 10/1998 | Arnold | |
| 5,901,620 | A | 5/1999 | Arnold | |
| D410,367 | S | 6/1999 | Applegate et al. | |
| 5,943,924 | A * | 8/1999 | Jarvis | 81/177.2 |

(Continued)

FOREIGN PATENT DOCUMENTS

| | | |
|---|---|---|
| FR | 2 605 918 | 5/1988 |

(Continued)

*Primary Examiner*—David B. Thomas
(74) *Attorney, Agent, or Firm*—Pillsbury Winthrop Shaw Pittman LLP

(57) ABSTRACT

A socket for transmitting torque from different types of wrenches to a fastener includes an elongated socket body. The body has a fastener engaging end with a plurality of internal fastener engaging surfaces defining an axially facing internal fastener engaging opening. The fastener engaging surfaces are configured to engage with the fastener. The body includes a drive end having an axially facing internal drive opening configured to receive a socket mounting portion from a socket driving type of wrench. The drive end of the socket body also has a series of external flat drive surfaces circumferentially separated by external surfaces having a smaller circumferential width. The flat surfaces are configured to be engaged by inwardly facing drive surfaces of an external driving type wrench. The socket body is tapered axially between the drive end and the fastener engaging end, with the drive end being wider than the fastener engaging end.

12 Claims, 6 Drawing Sheets

U.S. PATENT DOCUMENTS

| | | | | | |
|---|---|---|---|---|---|
| 5,957,012 | A | | 9/1999 | McCune | |
| 6,047,618 | A | | 4/2000 | Pieri | |
| D425,385 | S | * | 5/2000 | Jarvis | D8/29 |
| D442,837 | S | | 5/2001 | Porras | |
| 6,282,994 | B1 | * | 9/2001 | Wei | 81/121.1 |
| 6,397,706 | B1 | | 6/2002 | Maznicki | |
| D459,961 | S | * | 7/2002 | Carroll | D8/29 |
| D464,545 | S | * | 10/2002 | Marty et al. | D8/21 |
| D477,198 | S | | 7/2003 | Staton | |
| 2003/0126960 | A1 | * | 7/2003 | Chen | 81/121.1 |
| 2003/0154827 | A1 | | 8/2003 | Chang | |
| 2004/0074344 | A1 | * | 4/2004 | Carroll | 81/121.1 |

FOREIGN PATENT DOCUMENTS

| | | | | | |
|---|---|---|---|---|---|
| GB | 2246534 | A | * | 2/1992 | B25B 13/06 |

* cited by examiner

SOCKET

BACKGROUND OF THE INVENTION

1. Field of the Invention

The present invention relates to a socket for selectively engaging a fastener for applying torque thereto.

2. Description of Related Art

Sockets typically have an elongated ring-shaped wall that provides a smooth cylindrical outer peripheral surface. The typical socket has a nut end for engagement with a fastener, and a drive end that provides an opening for engagement with a drive tang or "lug" of a ratchet wrench.

The present invention provides an improved socket that enables the socket to be grasped by a socket wrench, an open-ended wrench, and/or by the fingers of a user.

BRIEF SUMMARY OF THE INVENTION

One aspect of the present invention relates to a socket for transmitting torque from different types of wrenches to a fastener. The socket includes an elongated socket body. The socket body has a fastener engaging end with a plurality of internal fastener engaging surfaces defining an axially facing internal fastener engaging opening configured to receive the fastener. The fastener engaging surfaces are configured to engage in torque transmitting relation with corresponding drive surfaces on the fastener when received in the fastener receiving opening. The socket body has a drive end axially opposite the fastener engaging end. The drive end has an axially facing internal drive opening configured to receive in torque receiving relation a socket mounting portion from a socket driving type of wrench. The drive end of the socket body also has a series of external flat drive surfaces circumferentially separated by external surfaces having a smaller circumferential width. The flat surfaces are configured to be engaged in torque receiving relation by inwardly facing drive surfaces of an external driving type of wrench. The socket body is tapered axially between the drive end and the fastener engaging end, with the drive end being wider than the fastener engaging end.

Another aspect of the present invention relates to a set of sockets including a first socket and a second socket. The first socket includes a first elongated socket body. The first socket body has a first fastener engaging end with a plurality of first internal fastener engaging surfaces defining a first axially facing internal fastener engaging opening configured to receive a fastener. The first fastener engaging surfaces are configured to engage in torque transmitting relation with corresponding drive surfaces on the fastener when received in the first fastener receiving opening. The first socket body has a first drive end axially opposite the first fastener engaging end. The first drive end has a first axially facing internal drive opening configured to receive in torque receiving relation a socket mounting portion from a socket-driving type of wrench. The first drive end of the first socket body also has a series of first external flat drive surfaces circumferentially separated by first external surfaces having a smaller circumferential width. The first flat surfaces are configured to be engaged in torque receiving relation by inwardly facing drive surfaces of an external-driving type of wrench. The second socket includes a second elongated socket body. The second socket body has a second fastener engaging end with a plurality of second internal fastener engaging surfaces defining a second axially facing internal fastener engaging opening configured to receive a fastener. The second fastener engaging surfaces is configured to engage in torque transmitting relation with corresponding drive surfaces on the fastener when received in the second fastener receiving opening. The second socket body has a second drive end axially opposite the second fastener engaging end. The second drive end has a second axially facing internal drive opening configured to receive in torque receiving relation a socket mounting portion from a socket-driving type of wrench. The second drive end of the second socket body also has a series of second external flat drive surfaces circumferentially separated by second external surfaces having a smaller circumferential width. The second flat surfaces are configured to be engaged in torque receiving relation by inwardly facing drive surfaces of an external-driving type of wrench. The first fastener engaging opening of the first socket is configured to receive the second drive end of the second socket with the first fastener engaging surfaces of the first socket engaging the second drive end of the second socket in torque transmitting relation.

Still another aspect of the present invention relates to a method of coupling a first socket with a second socket. The method includes providing a first socket including a first elongated socket body. The first socket body has a first fastener engaging end with a plurality of first internal fastener engaging surfaces defining a first axially facing internal fastener engaging opening configured to receive a fastener. The first fastener engaging surfaces are configured to engage in torque transmitting relation with corresponding drive surfaces on the fastener when received in the first fastener receiving opening. The first socket body has a first drive end axially opposite the first fastener engaging end. The first drive end has a first axially facing internal drive opening configured to receive in torque receiving relation a socket mounting portion from a socket-driving type of wrench. The first drive end of the first socket body also has a series of first external flat drive surfaces circumferentially separated by first external surfaces having a smaller circumferential width. The first flat surfaces are configured to be engaged in torque receiving relation by inwardly facing drive surfaces of an external-driving type of wrench. The method includes providing a second socket including a second elongated socket body. The second socket body has a second fastener engaging end with a plurality of second internal fastener engaging surfaces defining a second axially facing internal fastener engaging opening configured to receive a fastener. The second fastener engaging surfaces is configured to engage in torque transmitting relation with corresponding drive surfaces on the fastener when received in the second fastener receiving opening. The second socket body has a second drive end axially opposite the second fastener engaging end. The second drive end has a second axially facing internal drive opening configured to receive in torque receiving relation a socket mounting portion from a socket-driving type of wrench. The second drive end of the second socket body also has a series of second external flat drive surfaces circumferentially separated by second external surfaces having a smaller circumferential width. The second flat surfaces are configured to be engaged in torque receiving relation by inwardly facing drive surfaces of an external-driving type of wrench. The method includes coupling the first socket with the second socket such that the first fastener engaging opening of the first socket receives the second drive end of the second socket with the first fastener engaging surfaces of the first socket engaging the second drive end of the second socket in torque transmitting relation.

Other aspects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
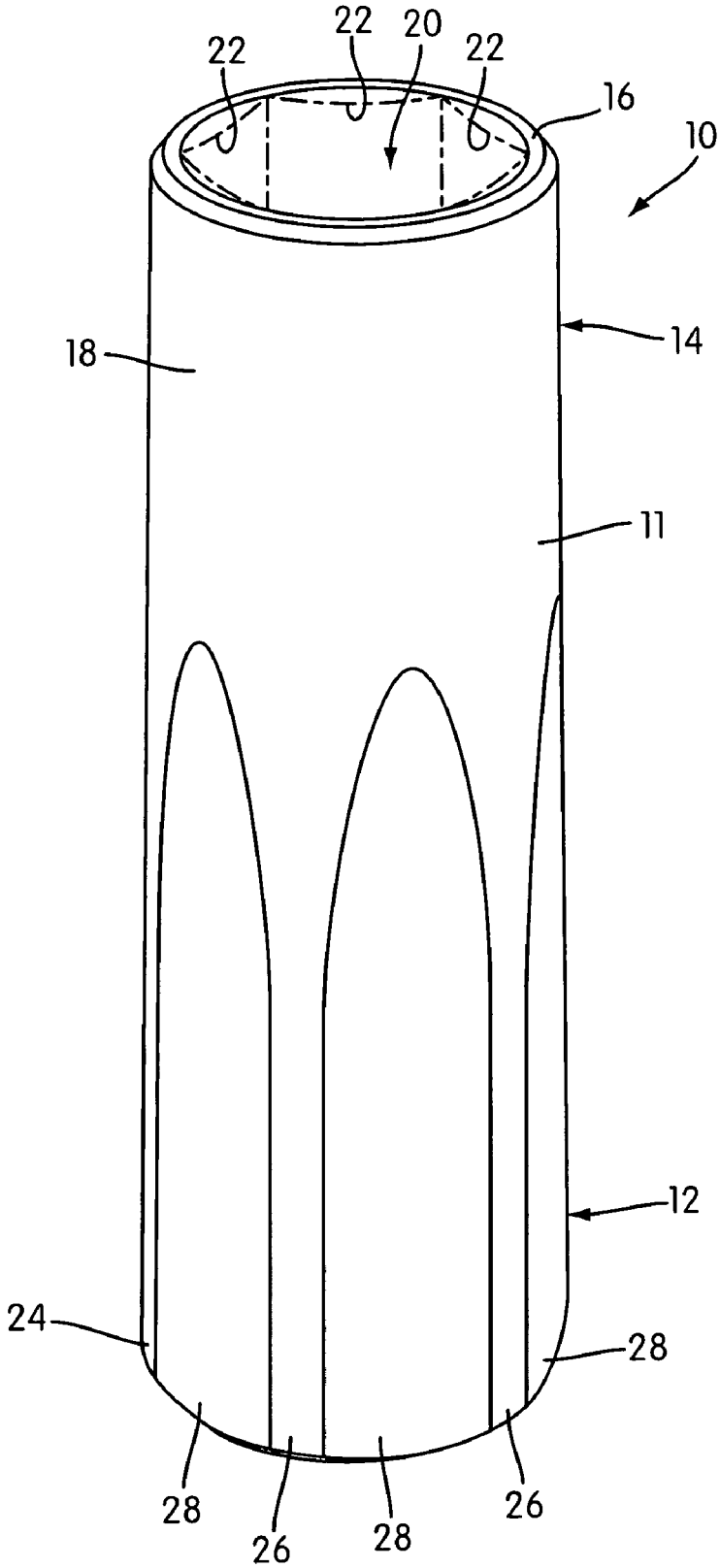
FIG. 1 is a perspective view illustrating a socket constructed in accordance with an embodiment of the invention.

FIGS. 1–5 illustrate a socket 10 constructed according to an embodiment of the present invention. The socket 10 includes an elongated socket body 11 having a fastener engaging end 14 and a drive end 12 axially opposite the fastener engaging end 14. The drive end 12 is constructed and arranged to be removably coupled to a wrench, and the fastener engaging end 14 is constructed and arranged to be removably coupled to a fastener of a predetermined size and configuration. As a result, torque applied to the wrench by a user is transmitted through the socket 10 to the fastener to effect rotation thereof.

The socket 10 is particularly advantageous in that the socket 10 is structured for transmitting torque from different types of wrenches to a fastener. That is, the drive end 12 can be removably coupled with both a socket-driving type of wrench having a socket mounting portion that is received inside the drive end 12 and an external-driving type of wrench, e.g., an open-ended wrench, having inwardly facing drive surfaces that engage the exterior of the drive end 12. Additionally, the drive end 12 of the socket 10 is suitably structured such that it can be manually grasped and rotated to effect rotation of a fastener, as will be further discussed.

The fastener engaging end 14 of the socket 10 has a ring-shaped wall 16 providing a smooth cylindrical outer peripheral surface 18. The fastener engaging end 14 also has a plurality of internal fastener engaging surfaces 22 that define an axially facing internal fastener receiving opening 20 configured to receive a fastener. The fastener engaging surfaces 22 are configured to engage in torque transmitting relation with corresponding drive surfaces on the fastener, such as the head of a headed bolt, when received in the fastener receiving opening 20. Torque is applied to the fastener to affect rotation thereof via the engagement between the fastener engaging surfaces 22 and the drive surfaces on the head of the fastener.

Figure 5:
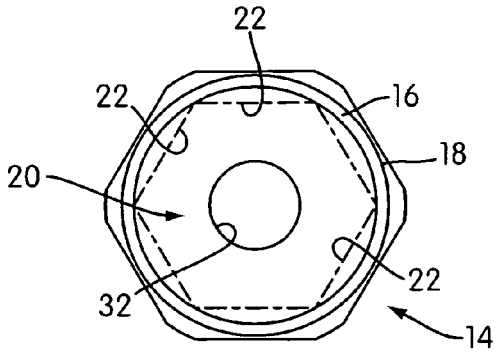
FIG. 5 is a fastener engaging end plan view of the socket shown in FIG. 1.
Figure 6:
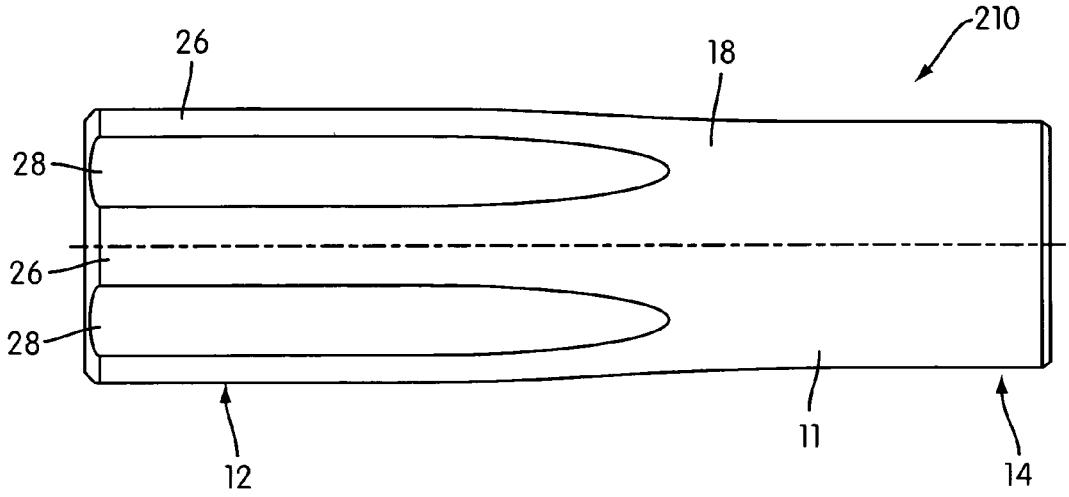
FIG. 6 is a side view of another embodiment of a socket.
Figure 7:
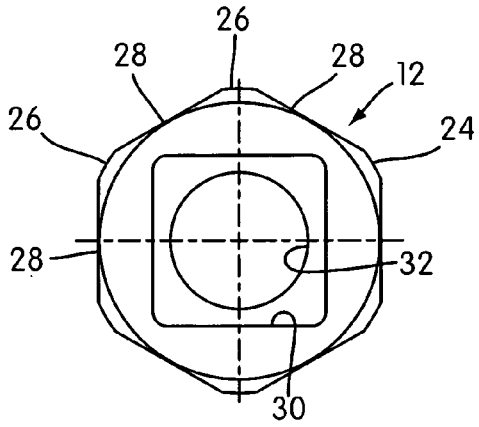
FIG. 7 is a drive end plan view of the socket shown in FIG. 6.
Figure 8:
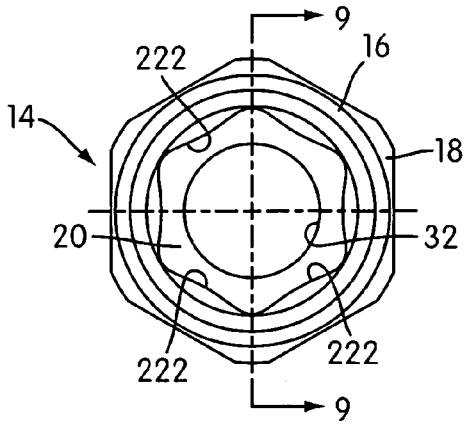
FIG. 8 is a fastener engaging end plan view of the socket shown in FIG. 6.
Figure 9:
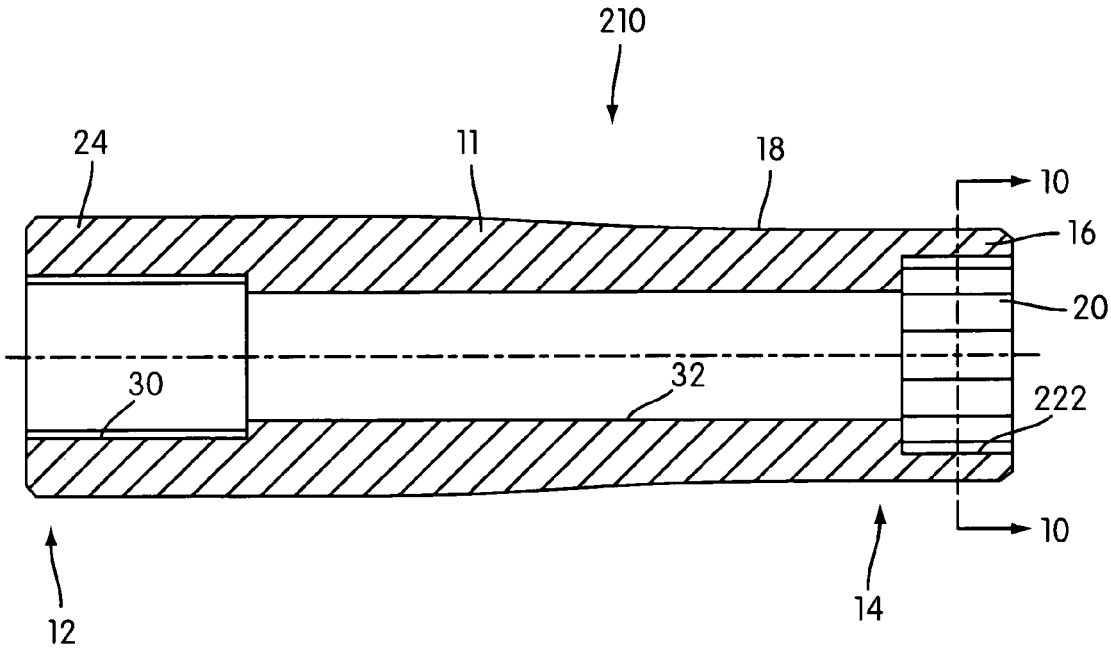
FIG. 9 is a cross-sectional view through line 9—9 of FIG. 8.
Figure 10:
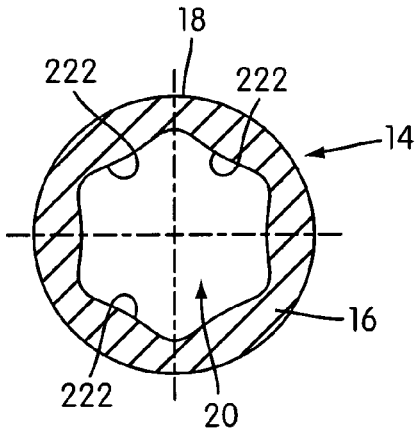
FIG. 10 is a cross-sectional view through line 10—10 of FIG. 9.

The fastener engaging surfaces 22 may have any suitable configuration for removably engaging with a fastener. For example, as shown in FIGS. 1 and 5, the fastener engaging end 14 has six of the fastener engaging surfaces 22 for removably engaging a six point fastener. However, the fastener engaging end 14 may have a suitable number of fastener engaging surfaces, e.g., four point, twelve point, inverted Torx®, or a hex bit driver with a radial fastener insertable through the socket wall. FIGS. 6–10 illustrate an embodiment of a socket 210 that includes six fastener engaging surfaces 222, wherein the fastener engaging surfaces 222 are convexly rounded at the six-points thereof (e.g., see FIGS. 8 and 10). The use of convex surfaces is preferred, but optional, because it transfers force to the center of the drive surfaces on the fastener, rather than the corners. The remaining elements of the socket 210 are substantially similar to the socket 10, and are indicated with similar reference numerals.

The drive end 12 has an axially facing internal drive opening 30 configured to receive in torque receiving relation a socket mounting portion from a socket-driving type of wrench. In the illustrated embodiment, the drive end 12 has a square internal drive opening 30 to enable removable engagement of the drive end 12 with a square socket mounting portion provided on a socket wrench. However, the opening 30 in the drive end 12 may have any other suitable configuration to enable removable engagement with a wrench, e.g., an internally geared configuration, a hexagonal configuration, etc. The wrench may have any suitable configuration for applying torque to the socket 10, e.g., ratcheting and non-ratcheting type, and may be manually, mechanically, or pneumatically operated.

The opening 30 in the drive end 12 communicates with the opening 20 in the fastener engaging end 14 to form a through hole 32 in the socket 10. In the illustrated embodiment, the through hole 32 is circular and serves as a bolt hole clearance. This feature is optional and can be advantageously used when threading a nut along a long threaded rod. In such a situation, the socket 10 can be slid over the rod with the fastener engaging end 14 engaging the nut. The user can rotate the socket 10 to in turn rotate the nut by either manually turning the socket or driving it with an open-ended wrench.

The drive end 12 of the socket body 11 has a hexagonal-shaped wall 24 that provides a series of external flat drive surfaces 28 circumferentially separated by external convex surfaces 26 on the outer peripheral surface thereof. In the illustrated embodiment, the drive end 12 has six of the external flat drive surfaces 28 circumferentially separated by six of the external convex surfaces 26 (also referred to as flutes). However, any other suitable number of external flat drive surfaces 28 and external convex surfaces 26 may be provided.

Figure 2:
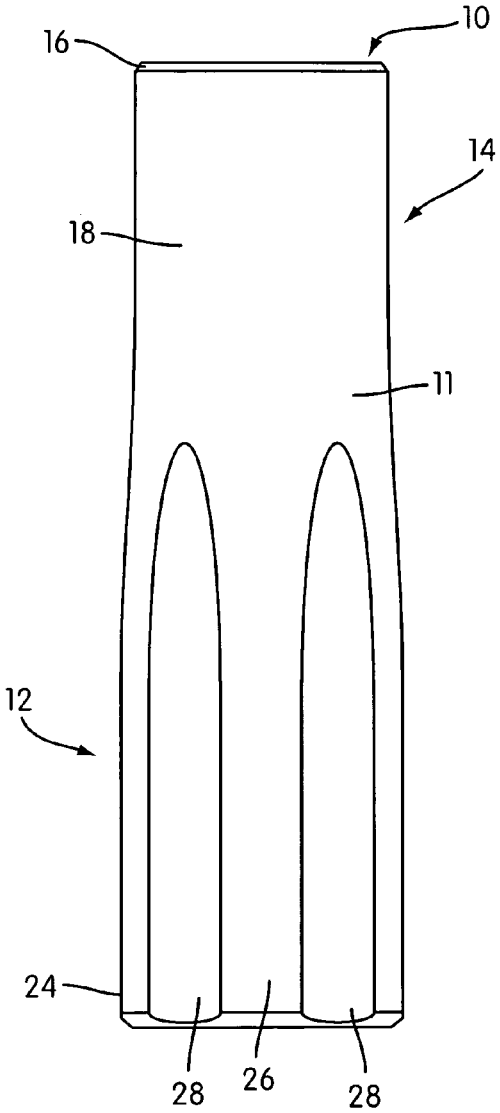
FIG. 2 is a right elevated view of the socket shown in FIG. 1.
Figure 3:
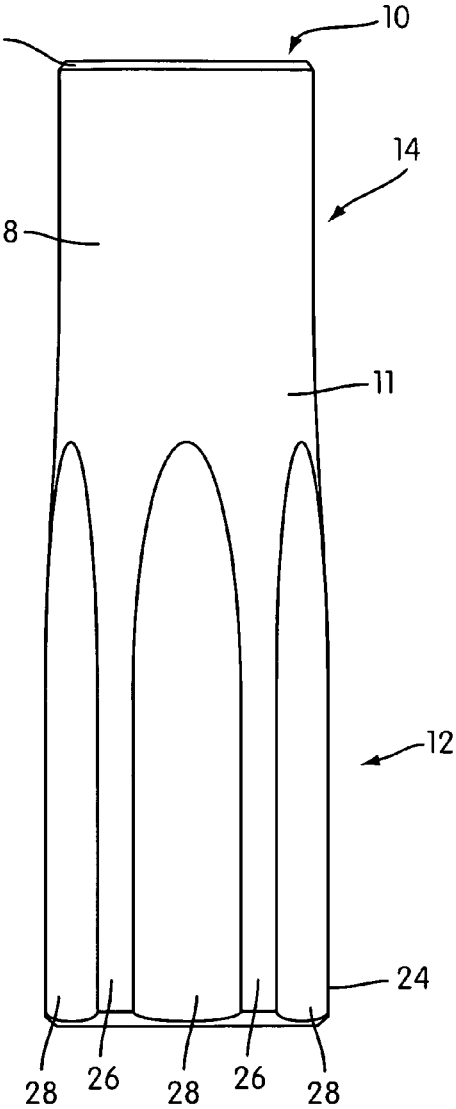
FIG. 3 is a left elevated view of the socket shown in FIG. 1.
Figure 4:
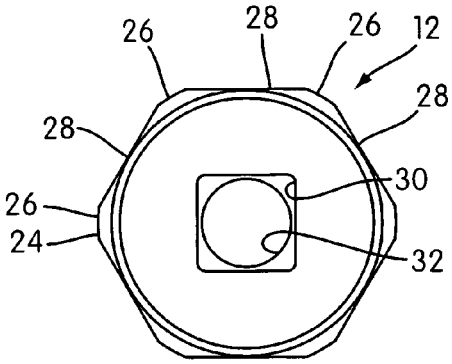
FIG. 4 is a drive end plan view of the socket shown in FIG. 1.

As illustrated, the flat drive surfaces 28 and convex surfaces 26 extend parallel to one another and along a substantial length of the socket body 11. As shown in FIGS. 2 and 3, the flat drive surfaces 28 and convex surfaces 26 extend about half the length of the socket body 11. As best shown in FIG. 4, a width in a circumferential direction of each flat drive surface 28 is greater than a width in the circumferential direction of each convex surface 26. For example, each convex surface 26 has a width that is less than 30% of a width of each flat drive surface 28. However, the widths of the convex surfaces 26 and flat drive surfaces 28 may be similar to one another.

The series of flat drive surfaces 28 on the drive end 12 provide outer drive surfaces that enable the socket 10 to be engaged in torque receiving relation by an open-ended wrench with inwardly facing drive surfaces. Also, the socket may be engaged with a closed-end wrench or pliers or any other type of device that will effectively engage the external flat drive surfaces 28 for applying torque. Collectively, these will be referred to as external-driving types of wrenches because they apply force to the external surfaces of an object, such as the flat surfaces on a bolt head, or the flat drive surfaces 28. Additionally, the series of convex surfaces 26 on the drive end 12 can be grasped by the fingers of a user to apply torque thereto. That is, the convex surfaces 26 present structures that facilitate the gripping of the outer periphery of the drive end 12 by a user, so the user can rotate the socket 10 manually so as to tighten or loosen a fastener without the need to use a wrench.

Moreover, the series of flat drive surfaces 28 separated by convex surfaces 26 provide an anti-roll feature to prevent rolling of the socket 10 along a substantially flat surface. That is, the alternating flat drive surfaces 28 and convex surfaces 26 provide a non-round outer peripheral surface that prevents the socket 10 from rolling away from the user when placed on a substantially flat surface.

As illustrated, the socket body 11 is tapered axially between the drive end 12 and the fastener engaging end 14, with the drive end 12 being wider than the fastener engaging end 14. The tapered body allows for improved access to narrow areas. Additionally, the tapered body provides improved stress distribution within the socket wall. Preferably, the tapering is gradual and occurs along a substantial length of the socket body's axial length.

Further, the wider drive end 12 of the socket body 11 allows the flat drive surfaces 28 to be wider, e.g., wider surface area, which enhances its use with a standard open-ended wrench. Additionally, the wider drive end 12 provides sufficient space for wider convex surfaces 26 that can be easily engaged by the user's fingers.

Figure 12:
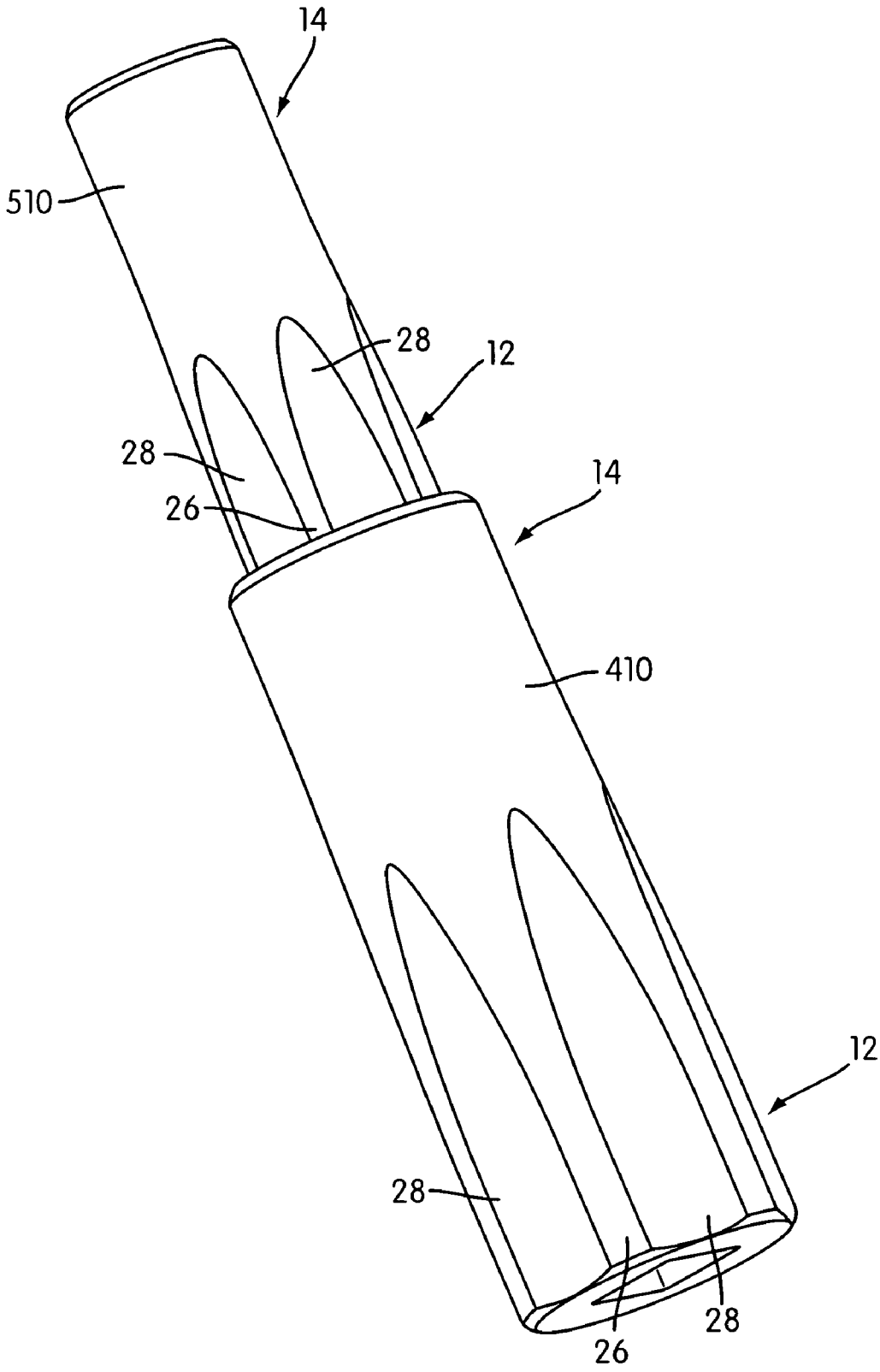
FIG. 12 is a perspective view illustrating the fastener receiving end of one socket receiving the drive end of another socket.

The flat drive surfaces 28 also enable the socket 10 to be operatively engaged with the fastener engaging surfaces of another socket in order to extend the length of the socket 10 in use. For example, the socket 10 may be one socket in a set of sockets each having a different sized fastener receiving opening defined by their respective internal fastener engaging surfaces. The fastener engaging opening of one of the sockets may be configured to receive the drive end of the socket 10 such that the internal fastener engaging surfaces of one of the sockets engage in torque transmitting relation with corresponding flat drive surfaces 28 on the drive end 12 of the socket 10, thereby extending a length of the socket 10. For example, in a set of sockets having configurations similar to socket 10 with different sized fastener receiving openings, a socket having a fastener receiving opening of 15 mm may be adapted to receive the drive end of a socket having a fastener receiving opening of 10 mm, because the drive end of the 10 mm socket has a width of about 15 mm (i.e., distance between flat driven surfaces). FIG. 12 illustrates the fastener receiving end of a 15 mm socket 410 receiving the drive end of a 10 mm socket 510. However, other combinations of different sized sockets may be adapted to be stacked with one another in a similar manner.

It should be understood that the convex surface 26 is a transition surface between adjacent flat drive surfaces 28 and may have other configurations than a convex configuration. That is, although a convex transition surface is illustrated, the transition surface may be concave, flat, or any other suitable contour.

It should also be understood that the rate of taper of the socket body 11 from the drive end 12 to the fastener engaging end 14 may vary depending on the size of the fastener receiving opening. For example, smaller sized sockets (i.e., sockets having smaller sized fastener receiving openings) may have a greater rate of taper than larger sized sockets (i.e., sockets having larger sized fastener receiving openings).

As discussed in U.S. Des. Pat. No. D477,198, the entirety of which is hereby incorporated into the present application by reference, the socket 10 may have different finishes and identifying indicia provided thereon in order to clearly differentiate different sized sockets. That is, the socket 10 may have special color-coded markings and coatings for identifying certain characteristics, such as size and type. The markings and coatings also may allow the socket 10 to have better visibility in dimly lit areas as well as from a distance.

For example, in a set of sockets, each socket may be provided with a different color marking corresponding to its size, thus allowing the user to select the appropriate sized socket based on its color, instead of having to read numbers that are usually machined into the socket.

Figure 11:
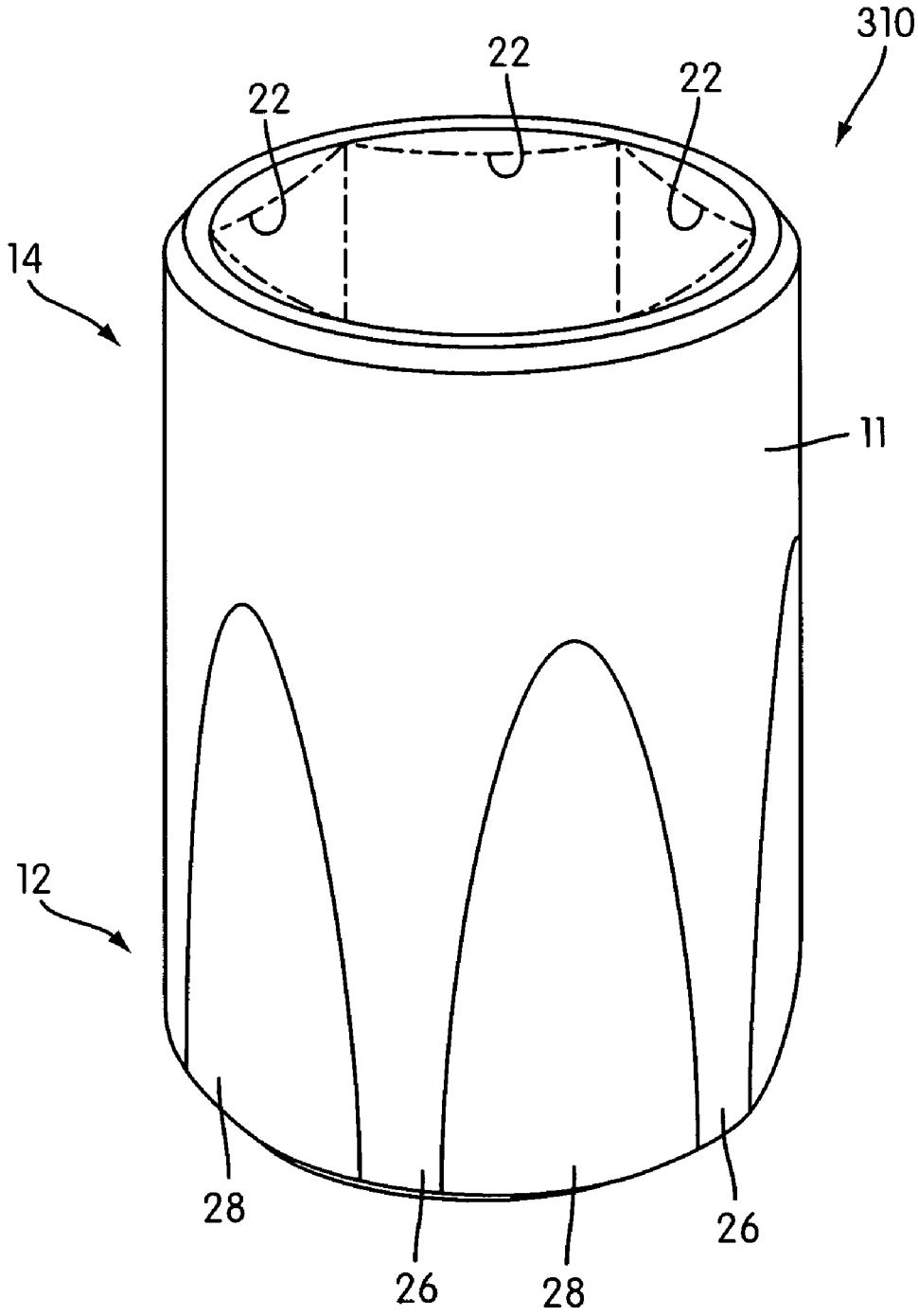
FIG. 11 is a perspective view of another embodiment of a socket.

FIGS. 1–10 illustrate embodiments of a socket 10, 210 having an elongated socket body, wherein the length of the socket 10, 210 far exceeds the average width of the socket 10, 210. However, the socket may have a more compact socket body, wherein the length and average width of the socket are more comparable, as shown in FIG. 11 which illustrates socket 310. Nevertheless, the socket may have any suitable sized length and width.

It can thus be appreciated that the aspects of the present invention have been fully and effectively accomplished. The foregoing specific embodiments have been provided to illustrate the structural and functional principles of the present invention, and are not intended to be limiting. To the contrary, the present invention is intended to encompass all modifications, alterations, and substitutions within the spirit and scope of the appended claims.

What is claimed is:

1. A socket for transmitting torque from different types of wrenches to a fastener, comprising:

an elongated socket body;

the socket body having a fastener engaging end with a plurality of internal fastener engaging surfaces defining an axially facing internal fastener engaging opening configured to receive the fastener, the fastener engaging surfaces being configured to engage in torque transmitting relation with corresponding drive surfaces on the fastener when received in the fastener receiving opening;

the socket body having a drive end axially opposite the fastener engaging end, the drive end having an axially facing internal drive opening configured to receive in torque receiving relation a socket mounting portion from a socket-driving type of wrench;

the drive end of the socket body also having a series of external flat drive surfaces circumferentially separated by external surfaces having a smaller circumferential width, the flat surfaces being configured to be engaged in torque receiving relation by inwardly facing drive surfaces of an external-driving type of wrench;

wherein the socket body is tapered axially between the drive end and the fastener engaging end, with the drive end being wider than the fastener engaging end.

2. A socket according to claim 1, wherein the socket body is tapered along a substantial axial portion thereof.

3. A socket according to claim 1, wherein the external surfaces having the smaller circumferential width are convex.

4. A socket according to claim 1, wherein the fastener engaging end has a ring-shaped wall providing a smooth cylindrical outer peripheral surface.

5. A socket according to claim 1, wherein the fastener engaging end has six of the fastener engaging surfaces for removably engaging a six point fastener.

6. A socket according to claim 1, wherein the drive end has six of the external flat drive surfaces separated by six of the external surfaces having the smaller circumferential width.

7. A socket according to claim 1, wherein the external flat drive surfaces and external convex surfaces extend along a substantial length of the socket body.

8. A socket according to claim 1, wherein the socket is one socket in a set of sockets each having a different sized fastener receiving opening defined by their respective internal fastener engaging surfaces, and wherein the fastener engaging opening of one of the sockets is configured to receive the drive end of another one of the sockets such that the internal fastener engaging surfaces of one of the sockets engage in torque transmitting relation with corresponding flat drive surfaces on the drive end of another one of the sockets, thereby extending a length of another one of the sockets.

9. A set of sockets comprising:

a first socket comprising:

a first elongated socket body;

the first socket body having a first fastener engaging end with a plurality of first internal fastener engaging surfaces defining a first axially facing internal fastener engaging opening configured to receive a fastener, the first fastener engaging surfaces being configured to engage in torque transmitting relation with corresponding drive surfaces on the fastener when received in the first fastener receiving opening;

the first socket body having a first drive end axially opposite the first fastener engaging end, the first drive end having a first axially facing internal drive opening configured to receive in torque receiving relation a socket mounting portion from a socket-driving type of wrench;

the first drive end of the first socket body also having a series of first external flat drive surfaces circumferentially separated by first external surfaces having a smaller circumferential width, the first flat surfaces being configured to be engaged in torque receiving relation by inwardly facing drive surfaces of an external-driving type of wrench; and a second socket comprising:

a second elongated socket body;

the second socket body having a second fastener engaging end with a plurality of second internal fastener engaging surfaces defining a second axially facing internal fastener engaging opening configured to receive a fastener, the second fastener engaging surfaces being configured to engage in torque transmitting relation with corresponding drive surfaces on the fastener when received in the second fastener receiving opening;

the second socket body having a second drive end axially opposite the second fastener engaging end, the second drive end having a second axially facing internal drive opening configured to receive in torque receiving relation a socket mounting portion from a socket-driving type of wrench;

the second drive end of the second socket body also having a series of second external flat drive surfaces circumferentially separated by second external surfaces having a smaller circumferential width, the second flat surfaces being configured to be engaged in torque receiving relation by inwardly facing drive surfaces of an external-driving type of wrench;

wherein the first fastener engaging opening of the first socket is configured to receive the second drive end of the second socket with the first fastener engaging surfaces of the first socket engaging the second drive end of the second socket in torque transmitting relation.

10. A set of sockets according to claim 9, wherein the first socket body is tapered axially between the first drive end to the first fastener engaging end, with the first drive end being wider than the first fastener engaging end, and wherein the second socket body is tapered axially between the second drive end to the second fastener engaging end, with the second drive end being wider than the second fastener engaging end.

11. A method of coupling a first socket with a second socket, comprising:

providing a first socket comprising:

a first elongated socket body;

the first socket body having a first fastener engaging end with a plurality of first internal fastener engaging surfaces defining a first axially facing internal fastener engaging opening configured to receive a fastener, the first fastener engaging surfaces being configured to engage in torque transmitting relation with corresponding drive surfaces on the fastener when received in the first fastener receiving opening;

the first socket body having a first drive end axially opposite the first fastener engaging end, the first drive end having a first axially facing internal drive opening configured to receive in torque receiving relation a socket mounting portion from a socket-driving type of wrench;

the first drive end of the first socket body also having a series of first external flat drive surfaces circumferentially separated by first external surfaces having a smaller circumferential width, the first flat surfaces being configured to be engaged in torque receiving relation by inwardly facing drive surfaces of an external-driving type of wrench;

providing a second socket comprising:

a second elongated socket body;

the second socket body having a second fastener engaging end with a plurality of second internal fastener engaging surfaces defining a second axially facing internal fastener engaging opening configured to receive a fastener, the second fastener engaging surfaces being configured to engage in torque transmitting relation with corresponding drive surfaces on the fastener when received in the second fastener receiving opening;

the second socket body having a second drive end axially opposite the second fastener engaging end, the second drive end having a second axially facing internal drive opening configured to receive in torque receiving relation a socket mounting portion from a socket-driving type of wrench;

the second drive end of the second socket body also having a series of second external flat drive surfaces circumferentially separated by second external surfaces having a smaller circumferential width, the second flat surfaces being configured to be engaged in torque receiving relation by inwardly facing drive surfaces of an external-driving type of wrench; and coupling the first socket with the second socket such that the first fastener engaging opening of the first socket receives the second drive end of the second socket with the first fastener engaging surfaces of the first socket engaging the second drive end of the second socket in torque transmitting relation.

12. A method according to claim 11, wherein the first socket body is tapered axially between the first drive end to the first fastener engaging end, with the first drive end being wider than the first fastener engaging end, and wherein the second socket body is tapered axially between the second drive end to the second fastener engaging end, with the second drive end being wider than the second fastener engaging end.

* * * * *